US006596348B2

(12) United States Patent
Hendriks

(10) Patent No.: US 6,596,348 B2
(45) Date of Patent: Jul. 22, 2003

(54) BUILDING INSULATION MATERIAL FORMED FROM BLANKETS HAVING COOPERATIVE INTERLOCKING SECTIONS

(75) Inventor: Joannes Hendriks, Vught (NL)

(73) Assignee: Clecon International B.V., Tilberg (NL)

( * ) Notice: Subject to any disclaimer, the term of this patent is extended or adjusted under 35 U.S.C. 154(b) by 0 days.

(21) Appl. No.: 10/132,574

(22) Filed: Apr. 26, 2002

(65) Prior Publication Data

US 2002/0132080 A1 Sep. 19, 2002

Related U.S. Application Data

(63) Continuation of application No. PCT/NL00/00778, filed on Oct. 26, 2000.

(30) Foreign Application Priority Data

Oct. 28, 1999 (NL) ..... 1013414

(51) Int. Cl.[7] ..... B32B 3/06

(52) U.S. Cl. ..... 428/1; 428/61; 428/99

(58) Field of Search ..... 428/57, 58, 61, 428/99, 100; 52/404.1, 406.1, 407.4, 404.4

(56) References Cited

U.S. PATENT DOCUMENTS

| | | | | |
|---|---|---|---|---|
| 4,581,269 A | * | 4/1986 | Tilman | 428/100 |
| 5,204,149 A | * | 4/1993 | Phenicie et al. | 428/61 |
| 5,427,169 A | | 6/1995 | Saulters | 160/368 |

FOREIGN PATENT DOCUMENTS

| | | |
|---|---|---|
| EP | 0250002 A1 | 6/1987 |
| EP | 0494 053 A1 | 7/1992 |

* cited by examiner

*Primary Examiner*—Alexander S. Thomas
(74) *Attorney, Agent, or Firm*—Pennie & Edmonds LLP

(57) ABSTRACT

An insulating material for building construction includes blankets provided with joining elements along their edges. The joining elements use a special zipper construction for forming a joint between individual blankets. The insulating material is suitable for forming wall or roof construction. The zipper construction is used for joining together blankets of such insulating material.

33 Claims, 3 Drawing Sheets

BUILDING INSULATION MATERIAL FORMED FROM BLANKETS HAVING COOPERATIVE INTERLOCKING SECTIONS

RELATED APPLICATIONS

This is Continuation of PCT/NL00/00778, filed Oct. 26, 2000, which published in English as WO 01/31133 on May 3, 2001.

FIELD OF THE INVENTION

The present invention relates to an insulating material comprising blankets to be used for insulating buildings, which blankets are provided with joining elements along their edges for forming a joint between individual blankets. The present invention furthermore relates to a method for joining together such insulating material comprising blankets and to a wall or roof construction comprising blankets that have been joined together.

BACKGROUND OF THE INVENTION

European patent application no. 0 494 053 discloses a shed with a pneumatic supporting structure, wherein the individual sheets are joined by means of the toothed zipper construction that has been known for a long time already. Such a joint is unsatisfactory as regards its insulating characteristics.

European patent application no. 0 250 002 discloses a closure system for insulating pipes, which closure system is cut out of the insulating material itself and which comprises interlocking teeth.

U.S. Pat. No. 5,427,169 discloses a mesh-like screen construction that is used as a flexible garage door screen. The mesh-like screen construction has a grid spacing wide enough to pass air and smoke but narrow enough to inhibit the passage of mosquitos, flies, and other pests. The joint between the screens is based on the traditional toothed zipper.

The insulating material referred to in the introduction is known per se, for example from U.S. Pat. No. 3,979,537. According to said US patent specification, the blankets are not glued or stapled together, but the blanket includes an edge strip, which edge strip forms an overlap with a next blanket, thus making it possible to provide the desired vapor barrier and the desired joint between the individual blankets. In addition, in many cases an additional stapled joint is used.

One drawback of a joint of this type is that frequently the roof construction exhibits ripples to a significant degree. Such ripples are formed when workers do not place blankets in proper abutment with each other and when differences in length occur during installation between blankets lying adjacently to each other. Another drawback is the fact that in a number of buildings the presence of a vapor-inhibiting screen on the insulating material in question is required for reasons relating to building physics, to which end special vapor-inhibiting foils are applied to the insulating blankets. In practice, however, the aforesaid connecting system constitutes a weak link, as a result of which the intended vapor-inhibiting effect is partially lost, which is undesirable. Another drawback is the fact that the blankets do not have a fixed point where to join each other, as a consequence of which such blankets cannot be positioned in proper parallel abutment with each other upon installation thereof, so that the blankets extend slightly obliquely and consequently the lengths of insulating material are not contiguous to each other. In addition, there is a considerable risk of thermal bridges being formed at the place where the blankets join each other, so that the primary function of the blanket, i.e. thermal insulation, is lost in part.

SUMMARY OF THE INVENTION

The object of the present invention is to eliminate the aforesaid drawbacks of the prior art, in particular with regard to the presence of folds, ripples and thermal bridges.

Another object of the present invention is to provide an insulating material that can be installed quickly and efficiently.

Another object of the present invention is to provide an insulating material that, once installed, can be removed again without damaging the insulating material.

Another object of the present invention is to provide an insulation system that can be installed in the roof of a building, for example, whilst a visually acceptable seam joint is maintained both on the front side and on the rear side, wherein the insulation system is also suitable for subsequent installation on the inside of the building.

Another object of the present invention is to provide an insulating material which can be installed by non-specialist personnel.

Yet another object of the present invention is to provide an insulating material by means of which a visually acceptable seam joint is obtained.

According to the present invention, the insulating material referred to in the introduction is characterized in that a zipper construction is used as the joining element, said zipper construction comprising: a blanket provided with a first joining strip including a first section, which extends continuously along the length of the first joining strip ;a blanket provided with a second joining strip including a second section, which extends continuously along the length of the second joining strip, wherein the dimension and the shape of said first section and said second section have been selected to enable the second section to engage in the first section in order to join the first joining strip and the second joining strip together so as to provide a joint between individual blankets.

The special construction for joining one or more blankets that is used in the present invention provides satisfactory thermal insulation. In addition, the blankets can be easily and quickly installed in parallel relationship to each other, thus providing a joint that is sound from the viewpoint of building physics(vapor-inhibition).

Although a glass fibre blanket comprising a zipper construction is known from U.S. Pat. No. 4,892,771, the use of the glass fibre blanket that is known therefrom is only suitable for insulating a boiler or a pipe. The special use according to the present invention, viz. the thermal or acoustic insulation of buildings is not known therefrom. Furthermore said patent specification provides no information with regard to the special zipper construction.

In addition to that, a construction for joining insulation elements is known from U.S. Pat. No. 5,526,626, which patent specification does not provide any special information with regard to the zipper construction, nor to the special use thereof for insulating buildings.

In a special embodiment of the present insulating material the zipper construction is preferably reclosable, so that the insulating material, once installed, can easily be removed again.

In addition to that it is desirable for the zipper construction to be in the form of an extruded plastic material.

If an additional closing effect for the interlocking sections is required, it is preferred to provide the joint thus obtained with for example a filling material, adhesive tape or the like. Such an operation may also result in a permanent seam joint between the sections.

It is in particular preferable that both the first section and the second section comprise one or more hook channels extending parallel to each other, which hook channels are complementary, so that the second section can engage in the first section. A construction of this kind ensures that the blankets are firmly joined, so that the blankets will not become detached from each other after some time.

Preferably, an adhesive or a weaving operation or a sealing operation is used for permanently or durably joining the joining strip to the blanket. Sealing is in particular preferred when using plastics that are to be joined by means of heat, whereby an additional joining effect can be obtained by applying adhesive tape. Such a manner of joining provides a durable joint between the joining strip and the blanket.

Furthermore it is preferred to add to the joining strip one or more agents from the group consisting of flame-retardants, vapor inhibitors, UV-stabilizers and anti-ageing agents. The use of such agents ensures that a durable and stable joint is obtained between blankets, whereby furthermore the requirements as regards vapor inhibition are met.

It is furthermore preferable that the joining strip be made of a flexible material, so that the blanket comprising such a joining strip can be produced in the form of a roll.

The blanket that is used in the present invention preferably comprises an under-layer, on which a layer of glass wool is present. Said under-layer preferably includes one or more materials selected from the group consisting of polyester, vinyl, aluminum foil, polypropylene and kraft paper.

The present invention furthermore relates to a method for joining together insulating material in the form of blankets, which method is according to the present invention characterized in that a first blanket including the first section of the first joining strip is placed in abutment with a second blanket including the second section of the second joining strip, after which the two sections are joined by having said second section engage in said first section, using a press-down member that can be moved over both sections.

The present insulating material is in particular used for wall and roof constructions, wherein acoustic and/or thermal insulation is required. On the other hand it is also possible to use the present insulating material for walls. Although only the term blankets is used herein, it should be understood that this term also includes foil-faced insulating blankets. Besides other applications, such foil-faced insulating blankets provided with the present zipper construction are also suitable for thermal and acoustic uses.

BRIEF DESCRIPTION OF THE DRAWINGS

The present invention will now be explained by means of a few examples, wherein reference is made to FIGS. 1–3.

DETAILED DESCRIPTION OF THE PREFERRED EMBODIMENT

Figure 1:
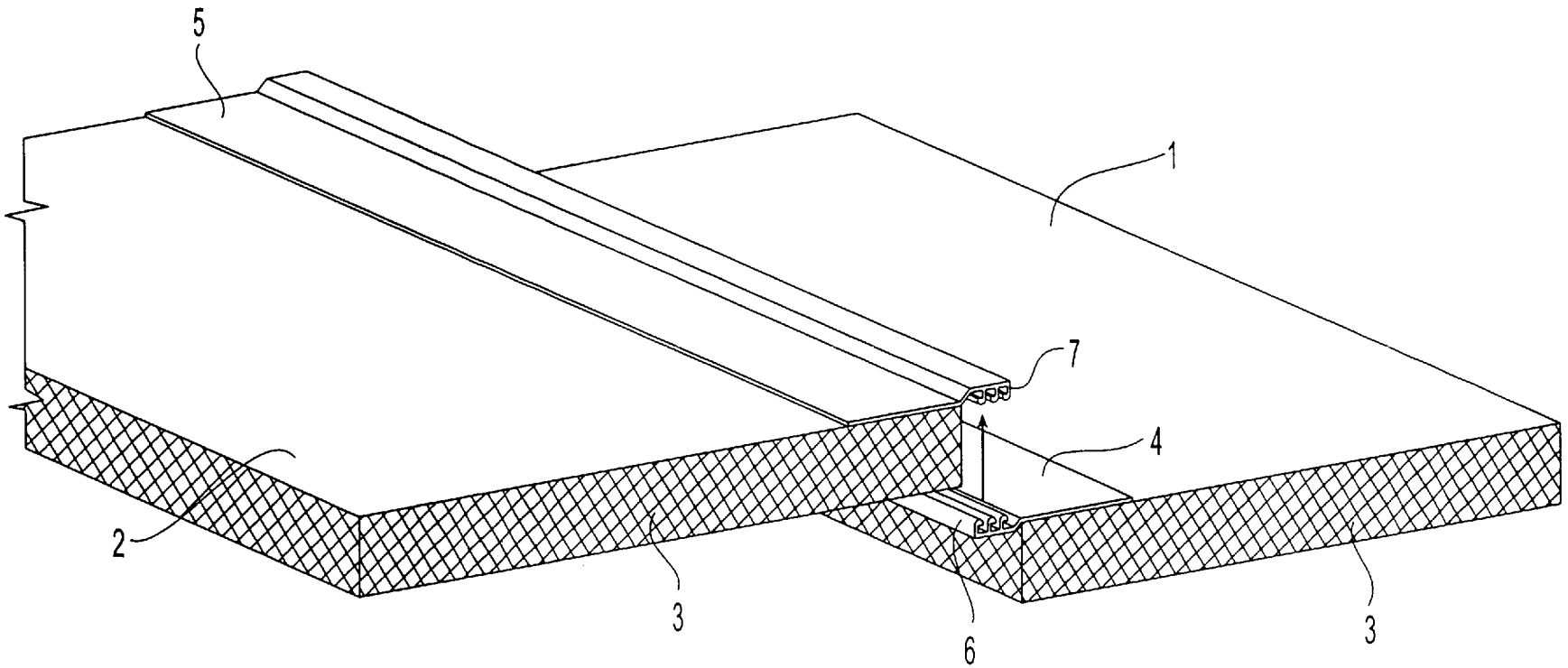
FIG. 1 shows two blankets according to the present invention.

FIG. 1 schematically shows a blanket 1, which blanket 1 comprises an amount of glass wool 3. Along its edge, blanket 1 comprises a first joining strip 4 including a first section 6,which extends continuously along the length of the first joining strip 4. The blanket indicated by numeral 2 also comprises an amount of glass wool 3, which blanket 2 includes a second joining strip 5 including a second section 7, which extends continuously along the length of the second joining strip 5. The joining strips 4,5 are joined to the respective blankets 1,2 by sealing, weaving or by means of an adhesive, for example.

Figure 2:
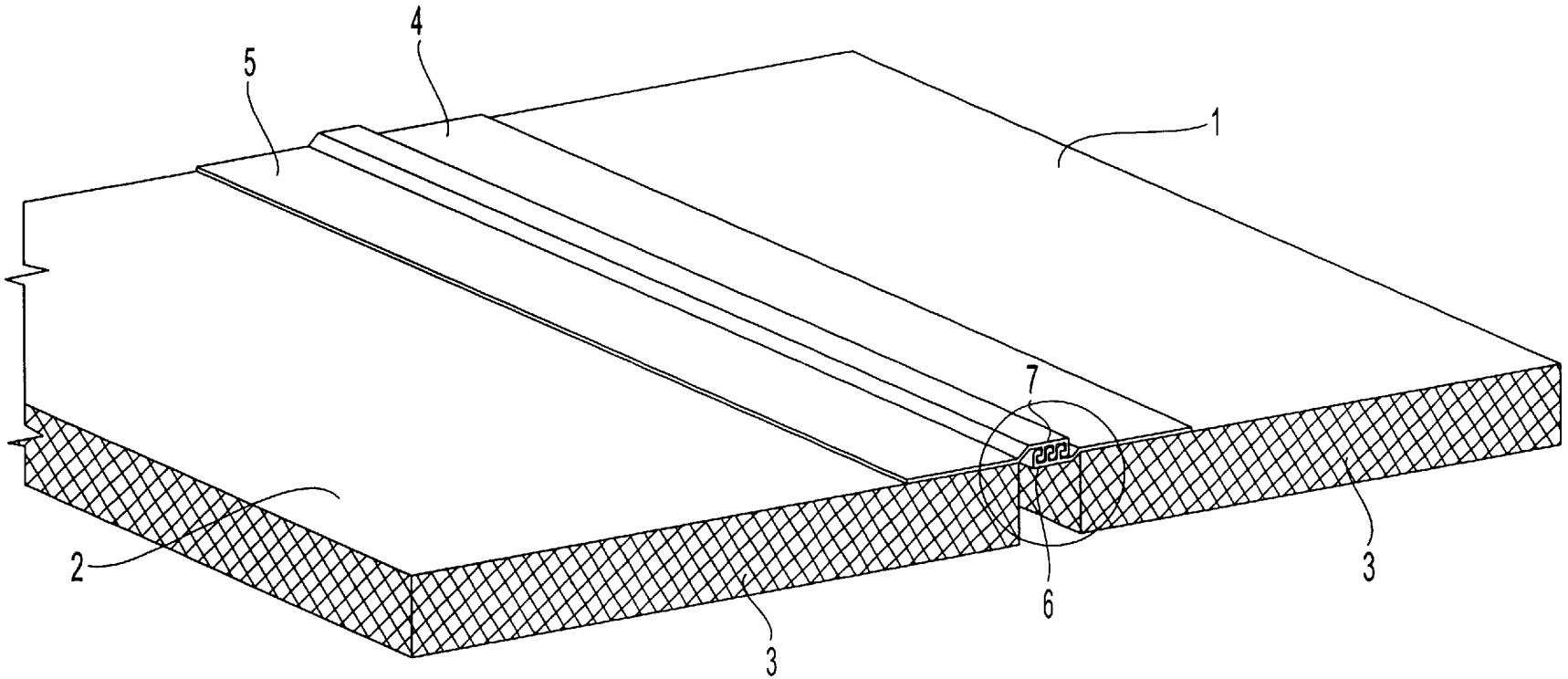
FIG. 2 shows two joined blankets according to the present invention.

FIG. 2 schematically shows the situation wherein blanket 1 is joined to blanket 2 by having first section 6 engage in second section 7, using a press-down member (not shown). Although the section 6, 7 is shown to comprise three parallel hook channels in FIGS. 1–3, which hook channels are complementary, so that the second section 7 can engage in the first section 6, it should be understood that the present invention is by no means limited to such a specific number of hook channels. Although only two blankets are joined in the figures, it should be understood that in principle an infinite number of blankets can be joined together by means of the present joining element.

Figure 3:
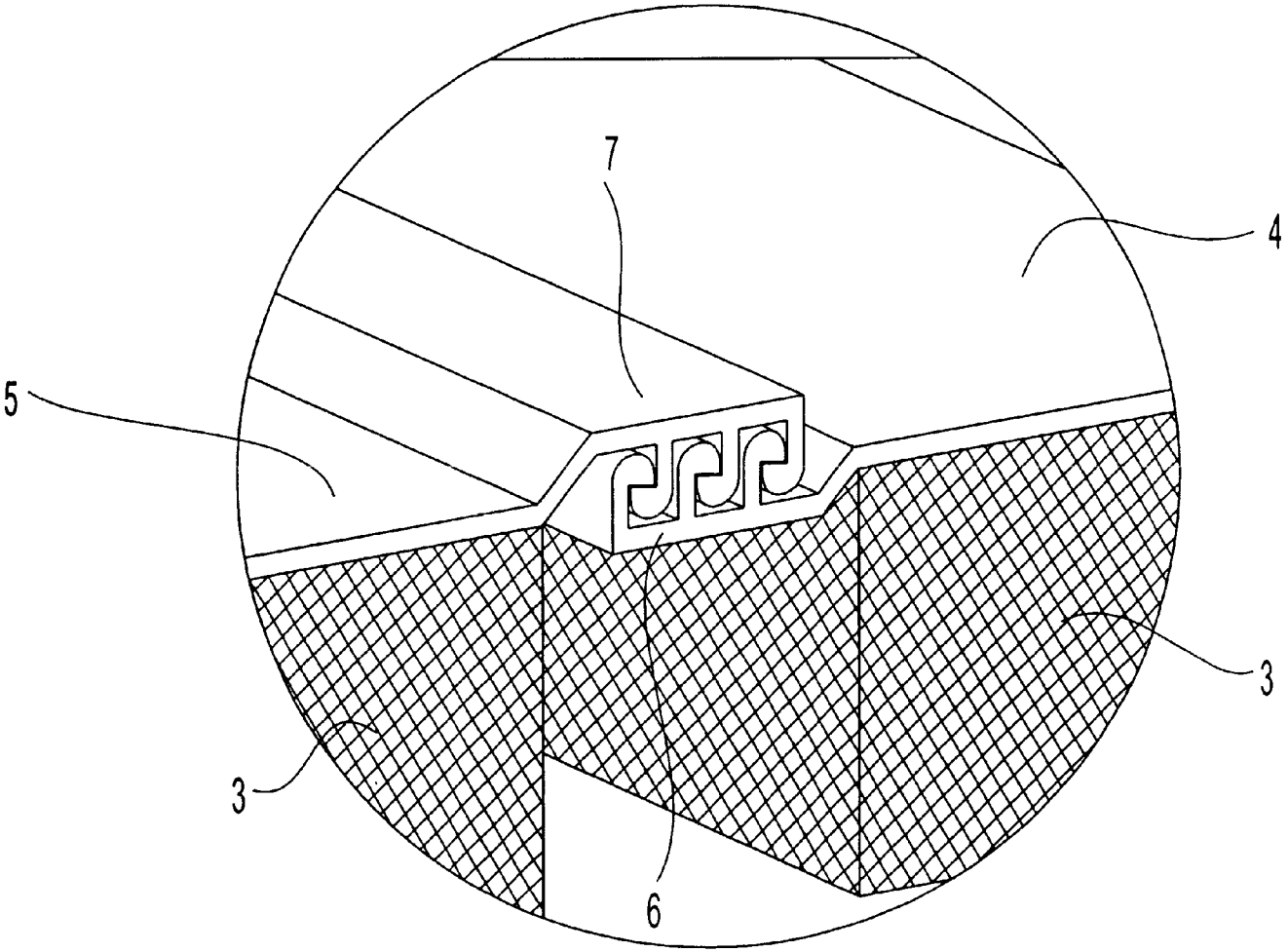
FIG. 3 is a detail view of the joint that is shown in FIG. 2.

FIG. 3, finally, is a detail view of the connection between the first joining strip 4 with first section 6 and the second joining strip 5 with second section 7,wherein the dimension and the shape of the first and the second section 6,7 have been so selected that second section 7 can engage in first section 6 for joining together the first joining strip 4 and the second joining strip 5.

It must be apparent that blankets can be joined together by means of the present joining element in a way that is sound from a viewpoint of building physics. If a blanket is provided with the present joining element on both sides, it is thus possible to join various lengths of insulating blankets together.

What is claimed is:

1. A building insulation material comprising at least one pair of blankets joined together at a zipper construction joint, the building insulating material comprising:

a first blanket comprising at least one glass wool layer, said first blanket having a first edge provided with a first joining strip, the first joining strip comprising a first interlocking section having at least one hook channel extending along a length of the first joining strip; and a second blanket comprising at least one glass wool layer, said second blanket having second edge provided with a second joining strip, the second joining strip comprising a second interlocking section having at least one hook channel extending along a length of the second joining strip; wherein said at least one hook channel of the first interlocking section and said at least one hook channel of said second interlocking section extend parallel to each other, are complementary to one another, and are shaped and dimensioned to engage one another so as to join the first joining strip and the second joining strip together to thereby form said zipper construction joint between said first and second blanket.

2. A building insulation material according to claim 1, wherein a joining strip is provided on each of a pair of opposite edges of both the first and second blankets.

3. A building insulation material according to claim 1, wherein said first and second blankets each comprises an under-layer on which a layer of glass wool is present.

4. An insulation material according to claim 3, wherein said under-layer comprises one or more materials selected from the group consisting of polyester, vinyl, aluminum foil, polypropylene and kraft paper.

5. An insulation material according to claim 1, wherein said first and second interlocking sections each comprise a plurality of hook channels.

6. An insulation material according to claim 1, wherein said first joining strip is joined to the first blanket by means of an adhesive.

7. An insulation material according to claim 6, wherein said second joining strip is joined to the second blanket by means of an adhesive.

8. An insulation material according to claim 1, wherein said first joining strip is joined to the first blanket by means of a weaving operation.

9. An insulation material according to claim 8, wherein said second joining strip is joined to the second blanket by means of a weaving operation.

10. An insulation material according to claim 1, wherein said first joining strip is joined to the first blanket by sealing.

11. An insulation material according to claim 10, wherein said second joining strip is joined to the second blanket by sealing.

12. An insulation material according to claim 1, wherein said first joining strip includes one or more agents from the group consisting of flame-retardants, vapor-inhibitors, UV-stabilizers and anti-ageing agents.

13. An insulation material according to claim 12 wherein said second joining strip includes one or more agents from the group consisting of flame-retardants, vapor-inhibitors, UV-stabilizers and anti-ageing agents.

14. An insulation material according to claim 1, wherein said first joining strip comprises an extruded plastic.

15. An insulation material according to claim 14 wherein said second joining strip comprises an extruded plastic.

16. An insulation material according to claim 1, wherein the first and second interlocking sections are provided with additional means for enhancing a closing action of the first and second interlocking sections.

17. A method for assembling building insulating material comprising:

providing a first blanket comprising at least one glass wool layer a first blanket having a first edge provided with a first joining strip, the first joining strip comprising a first interlocking section having at least one hook channel extending along a length of the first joining strip; and providing a second blanket comprising at least one glass wool layer the second blanket having a second edge provided with a second joining strip, the second joining strip comprising a second interlocking section having at least one hook channel extending along a length of the second joining strip;

arranging said first and second blankets such that the first interlocking section is in abutment with the second interlocking section;

moving a press-down member over said first and second sections to thereby cause the first and second interlocking sections to engage one another.

18. An insulative roof or wall construction comprising a plurality of joined together blankets, the insulative roof or wall construction comprising:

a first blanket comprising at least one glass wool layer, said first blanket having a first edge provided with a first joining strip, the first joining strip comprising a first interlocking section having at least one hook channel extending along a length of the first joining strip;

a second blanket comprising at least one glass wool layer, said second blanket having a second edge provided with a second joining strip, the second joining strip comprising a section interlocking section having at least one hook channel extending along a length of the second joining strip; wherein the at least one hook channel of the first interlocking section and the at least one hook channel of the second interlocking section extend parallel to each other, are complementary to one another, and are engaged to one another to thereby form a zipper construction joint between the first and second blankets.

19. The construction according to claim 18, wherein a joining strip is provided on each of a pair of opposite edges of both the first and second blankets.

20. The construction according to claim 18, wherein said first and second blankets each comprises an under-layer on which a layer of glass wool is present.

21. The construction according to claim 20, wherein said under-layer comprises one or more materials selected from the group consisting of polyester, vinyl, aluminum foil, polypropylene and kraft paper.

22. The construction according to claim 18, said first and second interlocking sections each comprise a plurality of hook channels.

23. The construction according to claim 18, said first joining strip is joined to the first blanket by means of an adhesive.

24. The construction according to claim 23, said second joining strip is joined to the second blanket by means of an adhesive.

25. The construction according to claim 18, wherein said first joining strip is joined to the first blanket by means of a weaving operation.

26. The construction according to claim 25, wherein said second joining strip is joined to the second blanket by means of a weaving operation.

27. The construction according to claim 18, wherein said first joining strip is joined to the first blanket by sealing.

28. The construction according to claim 27, wherein said second joining strip is joined to the second blanket by sealing.

29. The construction according to claim 18, said first joining strip includes one or more agents from the group consisting of flame-retardants, vapor-inhibitors, UV-stabilizers and anti-ageing agents.

30. The construction according to claim 29, said second joining strip includes one or more agents from the group consisting of flame-retardants, vapor-inhibitors, UV-stabilizers and anti-ageing agents.

31. The construction according to claim 18, wherein said first joining strip comprises an extruded plastic.

32. The construction according to claim 31, wherein said second joining strip comprises an extruded plastic.

33. The construction according to claim 18, wherein the first and second interlocking sections are provided with additional means for enhancing a closing action of the first and second interlocking sections.

* * * * *

UNITED STATES PATENT AND TRADEMARK OFFICE

CERTIFICATE OF CORRECTION

PATENT NO. : 6,596,348 B2
DATED : July 22, 2003
INVENTOR(S) : Joannes Hendriks

It is certified that error appears in the above-identified patent and that said Letters Patent is hereby corrected as shown below:

Column 5,
Line 43, replace the first occurrence of “a” with -- , the --.

Signed and Sealed this

Fourteenth Day of October, 2003

JAMES E. ROGAN
*Director of the United States Patent and Trademark Office*